US007515041B2

(12) United States Patent
Eisold et al.

(10) Patent No.: US 7,515,041 B2
(45) Date of Patent: Apr. 7, 2009

(54) DISASTER ALERT DEVICE AND SYSTEM

(75) Inventors: Douglas C. Eisold, San Diego, CA (US); Brent Perkins, Oceanside, CA (US); Paul Johnson, Kihei, HI (US); Paul Fairchild, San Diego, CA (US); Keneth Y. Tang, Alpine, CA (US)

(73) Assignee: Trex Enterprises Corp., San Diego, CA (US)

( * ) Notice: Subject to any disclaimer, the term of this patent is extended or adjusted under 35 U.S.C. 154(b) by 229 days.

(21) Appl. No.: 11/473,769

(22) Filed: Jun. 23, 2006

(65) Prior Publication Data

US 2007/0252688 A1 Nov. 1, 2007

Related U.S. Application Data

(60) Provisional application No. 60/795,922, filed on Apr. 29, 2006, provisional application No. 60/812,421, filed on Jun. 10, 2006.

(51) Int. Cl.
*G08B 29/00* (2006.01)

(52) U.S. Cl. ..... 340/506; 340/286.02; 340/539.17; 455/404.1

(58) Field of Classification Search ..... 340/506, 340/286.02, 539.17, 539.1, 425.5, 601, 690, 340/539.13, 421; 455/456.2, 456.6, 404.1, 455/404.2; 342/357.1; 725/35; 364/421; 324/232, 344

See application file for complete search history.

(56) References Cited

U.S. PATENT DOCUMENTS 6,169,476 B1 * 1/2001 Flanagan ..... 340/286.02
6,169,515 B1 * 1/2001 Mannings et al. ..... 342/357.1
6,329,904 B1 * 12/2001 Lamb ..... 340/286.02
6,608,559 B1 * 8/2003 Lemelson et al. ..... 340/539.13
6,650,647 B1 * 11/2003 Ishikawa et al. ..... 370/400
6,816,878 B1 * 11/2004 Zimmers et al. ..... 709/200
7,162,253 B2 * 1/2007 Vare et al. ..... 455/456.2
7,233,781 B2 * 6/2007 Hunter et al. ..... 455/404.1
2003/0069002 A1 * 4/2003 Hunter et al. ..... 455/404
2005/0009540 A1 * 1/2005 Lee et al. ..... 455/456.6
2005/0036620 A1 * 2/2005 Casden et al. ..... 380/259
2005/0066370 A1 * 3/2005 Alvarado et al. ..... 725/80

(Continued)

*Primary Examiner*—George A Bugg
*Assistant Examiner*—Hoi C Lau
(74) *Attorney, Agent, or Firm*—John R. Rose

(57) ABSTRACT

A disaster alert system and disaster alert devices for use in the system. Each disaster alert device includes a radio receiver, and a processor programmed to monitor radio transmissions from one or more central stations for disaster alerts directed to the location of the disaster alert device. Each alert device also includes an audio unit to alert personnel located at the site of the device to the precise nature of the disaster. The disaster alert devices are pre-programmed with information identifying the precise use location of the warning device. This use location information includes latitude and longitude of the use location and may also include other location information such as street address and zip code. Warnings are broadcast from central stations identifying with latitude and longitude information specific at-risk regions to which the warnings are directed which could be, for example, nationwide, statewide, countywide, or to much smaller regions, such as several houses on a single street or even a single residence. Each disaster alert device is preferably programmed to ignore all warnings directed to at-risk regions that do not include the latitude and longitude of the use location of the device.

22 Claims, 8 Drawing Sheets

U.S. PATENT DOCUMENTS

2006/0022819 A1* 2/2006 Vincent Granny et al. ..... 340/539.17
2006/0267783 A1* 11/2006 Smith ..... 340/601
2006/0273884 A1* 12/2006 Watkins et al. ..... 340/425.5
2007/0120664 A1* 5/2007 Bilbrey et al. ..... 340/539.32
2007/0296575 A1* 12/2007 Eisold et al. ..... 340/539.16

* cited by examiner

THIS WARNING DEVICE IS PROGRAMMED
FOR LOCATION AT THE FOLLOWING SITE:

13020 LONGBOAT WAY
DEL MAR, CA 92014
32° 56' 14.60" N
117° 14' 41.48" W

DISASTER ALERT DEVICE AND SYSTEM

This Application claims the benefit of Provisional Applications Ser. Nos. 60/795,922 filed Apr. 29, 2006 and 60/812,421 filed Jun. 10, 2006. This invention relates to disaster alert systems and in particular to such systems for providing alerts for actual or imminent disasters such as fires, tornados, tsunamis, floods, and terrorist attacks.

BACKGROUND OF THE INVENTION

Disaster alert devices are well known. A disaster alert device should be capable of waking-up and otherwise alerting people to pending danger and informing the people of the nature of the danger. Since disasters are normally very few and far between, people will be reluctant to purchase or use a warning device unless it is inexpensive, requires little or no attention, and produces very few false alarms. Since a disaster may interrupt outside power sources, the device should also not rely solely on outside power.

Fire and Smoke Detectors

Probably the most successful disaster alert device is the simple fire detector. An early fire detector invented in England by George Darby set off an alarm when a block of butter melted from the heat of the fire allowing two contacts to meet closing an electric circuit. The ionization chamber smoke detector was invented in the early 1940s in Switzerland and introduced into the U.S. in 1951. The sensitive component of the ionization detector is an ionization chamber that is open to the atmosphere. A radioactive source inside the chamber emits radiation that ionizes the air in the chamber and makes it conductive. In 1973, only 250,000 ionization type smoke detectors were sold. Most of these went to public and commercial buildings. Relatively few were installed in homes. This number increased dramatically over the next five years. In 1978, approximately 14 million ionization detectors were sold, mostly for use in homes. Over this period, the percentage of homes with smoke detectors rose from 10% to 77%. At present, over 80% of homes are believed to have one or more ionization detectors. Most ionization detectors sold today use an oxide of americium-241 (Am-241) as the radioactive source. The typical radiation activity for a modern residential ICSD is approximately 1 micro-Curie, while the activity in one used in public and commercial buildings might be as high as 50 μCi. In 1980, the average activity employed in a residential smoke detector was approximately 3 μCi, three times higher than it is today. Am-241 is an alpha emitter, but it also emits a low energy (59.5 keV) gamma ray. The Am-241 is mixed with gold and incorporated into a composite gold and silver foil sandwich. The source is 3 to 5 mm in diameter, and either crimped or welded into place inside the chamber. Optical smoke detectors are also in extensive use. These detectors include a collimated light source and a photodiode or other photoelectric sensor positioned at right angles to the beam. In the absence of smoke the beam passes in front of the detector but when visible smoke enters the beam some of the light is scattered by the smoke particles and is detected by the sensor. In a 2004 report The US National Institute of Scientific Testing reported that ionization detectors responded better to flaming fires than the optical type but that the optical type responded faster to smoldering fires. Smoke detectors are inexpensive. The lowest price ionization type detector costs about $8 and the lowest price optical detectors costs about $30.

Available Battery Power Sources

Almost all smoke detectors contain a battery power source. For about 72 percent of these detectors batteries are the only power source. Some smoke detectors are connected to utility electric power but these detectors may have a backup battery in case the utility power is interrupted. Smoke detectors are the most common devices generally located where people live and work which are equipped with always available power sources. There are, however, many other existing devices in use which require always available power sources. These include emergency lights or emergency lighting systems in commercial and industrial buildings. Plug-in flashlights with rechargeable batteries and a night light are available widely used in homes for emergency lighting. Some computer systems normally connected to utility power are fitted with backup battery power. Laptop computers and many other electronic devices are equipped with rechargeable batteries. Emergency shelters are typically equipped with battery power.

Warnings of Impending Outside Disasters

The smoke detector is an extremely valuable tool for detecting fires originating within a structure, but provides little or no warning of outside impending disasters such as approaching fires, tornados, tsunamis, floods, and terrorist attacks. Warnings of these types of disasters typically come from public sources. Some localities have public sirens that are operated when local emergency personnel become aware of weather-related events such as tornados or tsunamis. In some cases trucks with loudspeakers are used by public officials to warn of impending disasters. Warning systems such as sirens and loudspeakers are not effective for people that are too far away to hear the warning. A warning provided by loudspeakers on trucks can be delivered only to those places the truck can reach in time to deliver an effective warning.

The NWR SAME System

The National Emergency Alert System (EAS) was established by the Federal Communication System in November of 1994. The EAS replaced the Emergency Broadcast System as a tool the President of the United States and others may use to warn the public through radio, television, and cable stations about emergency situations. Stations are required to interrupt regular programming and to broadcast the emergency information. The broadcast is directed to the audiences of the various radio and television stations with no discrimination. These warnings may be from the President if national in scope or from state and local authorities. Warnings delivered by radio or television are ineffective for people who do not at the time of the warning have their radio of television turned on.

To try to provide warnings to people not watching or listening to television or radio, the United States Department of Commerce, the National Oceanic & Atmospheric Administration (NOAA), and the National Weather Service have developed a national weather service all hazards Specific Area Message Encoding system (referred to as NWR SAME or SAME) for delivering warnings of impending disasters via coded radio broadcasts. The coded messages identify types of dangers and regions within which the danger exists. NWR refers to a series of radio stations in the United States that broadcast weather information. Today, there are 884 stations broadcasting on the NWR network covering about 97 percent of the United States population. The SAME system provides header information in broadcasts that permit automatic triggering of receiver alarms in homes for specifically defined user selected preprogrammed locales and events. A publication describing the system is available at the time of this Application on the Internet at http://www.nws.noaa.jov/directives/. In cooperation with government agencies the Consumer Electronics Association in 2003 approved standards for public alert radio and television receivers. These receivers monitor free public broadcasts from NOAA and Canadian government agency. These public alert devices can be tailored to respond to specific alerts that are broadcast by NWR or government agencies. Specific headers on the broadcasts give information about the region where the warning is directed and the type of emergency. The devices can be purchased at many commercial outlets at prices of less than $100 and can be programmed to respond to any of a list of 62 types of disasters. Headers are also programmed to indicate counties or portions of counties to which warnings are directed. Currently, the smallest area to which a warning may be directed is one-tenth of a county. (This is done with a header number, 0 to 9.) The devices are programmed to analyze the header and to ignore all warnings (within the list of 62 warnings) other than the types of warnings selected for a response and to ignore all warnings directed to regions outside a selected county of a selected portion of a county. These devices come in a wide variety of models, with many options and functions, including adjustable sirens, visual readouts, silent visual modes, chimes, and voice information. The devices are based on digital data decoding techniques, which allows alerts to be triggered through alert-capable bedside radios, home security systems, televisions, and phones. The devices provide alerts in all 50 states of the United States and some models are customized for coverage in Canada or both US and Canada. Important problems with the SAME system is that the devices tend to be complicated to program and it is difficult or impossible to program the devices to receive just the warning you need without getting a lot of warnings you do not need or want. For example, the warning agency may need to send a warning into the homes of thousands or millions of people to warn only a few who may be in danger. No one likes to be woken up unnecessarily. In addition, evil people could transmit false alarms that could cause mass confusion. A very small percentage of the United States population currently is equipped with receivers to be able to take advantage of the SAME alert system. We need a better system.

Prior Art Patents

U.S. Pat. No. 6,295,001 describes a tornado warning system in which National Weather Service broadcasts are monitored and filtered to identify tornado risks at particular regions. A radio alert signal is then broadcast to pager receivers programmed with the same sub-address within a region or grid block where the tornado threat was located. The pager then generates an audible signal. In one particular embodiment the pager was co-located with a smoke detector. Another prior art patent example is U.S. Pat. No. 6,084,510, in which warning devices containing GPS receivers are distributed among a large number of locations. An emergency center, upon recognition of a pending disaster, transmits via radio a warning coded with GPS information identifying the at risk region. The warning device compares its own GPS position with the identified at risk region and if they correlate the device issues a warning signal.

Latitude and Longitude

Any location on Earth can be described by two numbers—its latitude and its longitude. If a pilot or a ship's captain wants to specify position on a map, these are the "coordinates" they would use. Actually, these are two angles, measured in degrees, "minutes of arc" and "seconds of arc." These are denoted by the symbols (°,',") e.g. 35° 43'9" means an angle of 35 degrees, 43 minutes, and 9 seconds (do not confuse this with the notation (',") for feet and inches.). A degree contains 60 minutes of arc and a minute contains 60 seconds of arc.

Latitude

Imagine the Earth is a transparent sphere (actually the shape is slightly oval; because of the Earth's rotation, its equator bulges out a little). Through the transparent Earth (drawing) we can see its equatorial plane, and its middle the point is O, the center of the Earth. To specify the latitude of some point P on the surface, draw the radius OP to that point. Then the elevation angle of that point above the equator is its latitude λ—northern (N) latitude if north of the equator, southern (S) latitude if south of it. On a globe of the Earth, lines of latitude are circles of different size. The longest is the equator, whose latitude is zero, while at the poles—at latitudes 90° north and 90° south the circles shrink to a point.

Longitude

On the globe, lines of constant longitude ("meridians") extend from pole to pole. Every meridian must cross the equator. Since the equator is a circle, we can divide it, like any circle, into 360 degrees, and the longitude of a point is then the marked value of that division where its meridian meets the equator. What that value is depends of course on where we begin to count, that is, on where zero longitude is. For historical reasons, the meridian passing the old Royal Astronomical Observatory in Greenwich, England, is the one chosen as zero longitude.

Digital Maps Showing Latitude and Longitude

Digital maps of the entire earth are available on the Internet that show latitude and longitude of any place on earth with an accuracy of a few feet. Individual houses and streets are clearly identifiable and by operating a computer mouse the latitude and longitude of any point on earth can be determined in a matter of seconds. Also, programs are available that permit a determination of latitude and longitude of any street address in the United States and many other places. Google Earth® (http://earth.google.com/) is an Internet web site that displays a Satellite image of any location in the United States and most other locations in response to the typing in a street address. The image can be overlaid with latitude and longitude coordinates. For example, FIG. 8 is a Google® printout of a digital satellite image showing Longboat Way, Del Mar, Calif. which is a cul-de-sac street, shown at 18, just west of Interstate 5, shown at 20, about 15 miles north of downtown San Diego. Portions of the image can be magnified so that objects as small as automobiles are clearly visible. Pointing a little arrow on the monitor screen using the computer mouse produces a digital display of the precise latitude and longitude of any object such as a residence that is pointed at. For example, the latitude and longitude of the residence located at 13020 Longboat Way, Del Mar Calif. is: N 32° 56'14.60" and W 117° 14'41.48". The accuracy of the pointer is about 0.01 to 0.10 second of arc which corresponds to about 0.3 meters to 3 meters (about 1 to 10 feet).

Encryption

Public Key Cryptography is well known in the art and involves a method of encryption and decryption of information using two numeric keys, one public and one private. The private key is kept secret and distributed to only one or few individuals. The public key is widely distributed to many individuals, and its value is publicly known. Encryption of data takes place using one of the keys, and decryption of data is performed using the other key. Knowledge of one of the keys, and the ability to use it to decrypt data does not give one the ability to derive the key used to perform the data encryption function (given sufficiently large key lengths).

What is Needed

What is needed is a better warning system for warning of all potential disasters that is very inexpensive, that is very easy to utilize, that can be directed to regions as large as a nation or several nations or directed to regions as small as individual residences, and that can be made available to virtually every person in the country.

SUMMARY OF THE INVENTION

The present invention provides a disaster alert system and disaster alert devices for use in the system. Each disaster alert device includes a radio receiver, and a processor programmed to monitor radio transmissions from one or more central stations for disaster alerts directed to the location of the disaster alert device. Each alert device also includes an audio unit to alert personnel located at the site of the device to the precise nature of the disaster. The disaster alert devices are preprogrammed with information identifying the precise use location of the warning device. This use location information includes latitude and longitude of the use location and may also include other location information such as street address and zip code. Warnings are broadcast from central stations identifying with latitude and longitude information specific at-risk regions to which the warnings are directed which could be, for example, nationwide, statewide, countywide, or to much smaller regions, such as several houses on a single street or even a single residence. Each disaster alert device is preferably programmed to ignore all warnings directed to at-risk regions that do not include the latitude and longitude of the use location of the device.

Preferably, to minimize required battery power the devices are programmed to sleep almost all the day and night but to wake up and listen for a warning for only very short periods of time such as one second each five minutes. The awake periods are preferably the same for all battery powered devices located in relatively large contiguous regions. The central stations that broadcast warnings are aware of the awake times, and the central stations are programmed to broadcast warnings to those devices during an awake period. Timing components in the disaster alert devices keep them synchronized with computers at the central stations. Preferably, each central station is equipped with a computer system with digital maps having latitude and longitude overlays so that at-risk regions can be specified, by personnel at a central station (or emergency personnel in contact with the central station), in terms of one or more approximately rectangular latitude and longitude regions. The computer system at the central station is preferably programmed to quickly incorporate this latitude and longitude data defining the at risk region in an information header that is broadcast by the central station along with an audio message providing a warning and instructions to people in the at-risk region. Disaster alert devices within the radio audience of the central station radio are awake during the broadcast and receive the header information. The header information is analyzed by the disaster alert devices and compared with their preprogrammed latitude and longitude positions. If they are outside the at risk region, they go back to sleep. If they are within the at risk region, they respond by recording the warning and instruction, sound an alarm, and audibly broadcast the warning and instructions.

In a preferred embodiment, mobile disaster alert devices incorporating a GPS device may be made available for mobile vehicle such as boats, cars and trucks. Each of these devices compare its actual latitude and longitude with the latitude and longitude information broadcast by the central station to determine if the device is in an at risk region. These mobile alert warning systems can also be incorporated in electronic devices that people typically carry around such as laptop computers and cell phones. These devices can get their GPS position from an incorporated GPS device or other sources.

Important advantages of the present invention over prior art alert warning systems, including the SAME system discussed in the Background section, is that warnings are in control of the emergency personnel responsible for providing the warnings. They decide when to issue a warning, the nature of the warning, and who receives it. Individuals are not required to take any action at all except to obtain a disaster alert device according to the present invention, locate it at appropriate place, and if battery operated, replace the battery about once per year. The devices are preprogrammed with the appropriate position data by trained personnel providing the devices. No programming by the users is necessary.

Alert warning devices may be distributed by mail and programmed by a computer before mailing that incorporates the appropriate latitude and longitude into the devices based on street addresses simultaneously with providing the address for mailing the device. The use position for the disaster alert device preferably is also printed on the device itself. Having control of the warning and who receives it permits emergency personnel at central offices to limit the warning to only those people within an at-risk region which can be as small as desired. The disaster alert devices can be very simple devices and mass production should cost less than $10. False alarms should be very rare. It is reasonable to expect that the devices will be utilized at least as universally as smoke detectors, both in residences and in work places. (In fact, in preferred embodiments, the disaster alert devices may be incorporated in a smoke detector or a smoke detector is incorporated in the device.) The devices may be required by public authorities or provided free of charge to persons living in some regions, such as flood plains, coastal regions subject to tsunami threats, regions near chemical plants, and regions near nuclear plants. They could also be required in new homes. Basically, there is no good reason not to have a disaster alert device according to the present invention located where you work and where you live.

DETAILED DESCRIPTION OF PREFERRED EMBODIMENTS

First Preferred Embodiment

Disaster Alert Device

Figures 1, 1A:
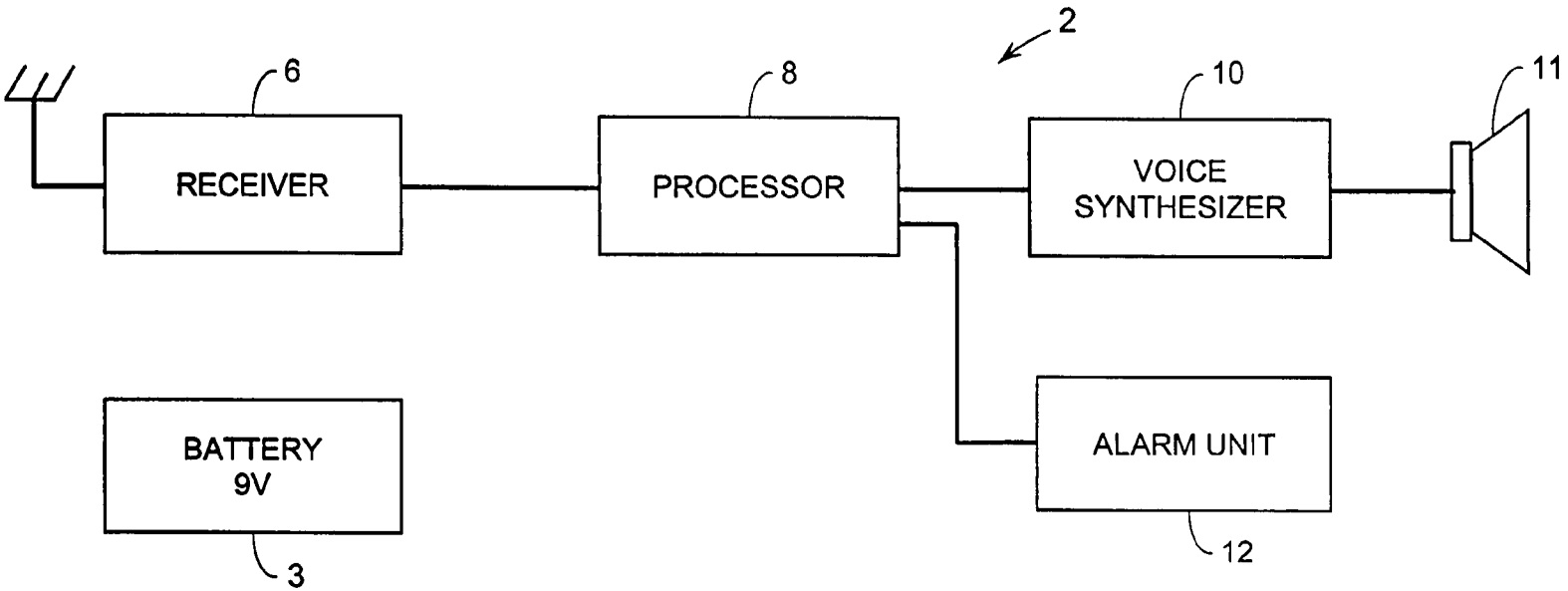
FIGS. 1 and 1A describe a first preferred disaster alert device.

A first preferred embodiment of the present is described by reference to FIGS. 1, 1A, 2 and 4-7. FIG. 1 and 1A shows at 2 components of a preferred disaster alert device according to the present invention. The device is battery powered with a 9-volt battery 3 and also includes additional components for receiving and responding to disaster alert radio warnings. These additional components include radio receiver 6, processor 8, voice synthesizer 10, speaker 11, and alarm unit 12. As indicated in FIG. 1A each disaster alert device preferably is programmed by the supplier of the device with information identifying its "use location". This programming can be done at a retail outlet at the time of sale, or it can be done in connection with mailing the device or in connection with the installation of the device if it is installed by the seller. Like a smoke detector, no programming by the consumer is required. This use location information includes the latitude and longitude of the location where the device will be installed and used. Latitude and longitude can also be determined using maps at the point of sale. Latitude and longitude can also easily be determined using GPS devices by sales personnel if these devices are sold door to door or by installation personnel. Also, Google Earth® web site and other Internet sites provide latitude and longitude corresponding to street addresses. (For example, when a street address is typed into a fill-in a Google Earth text block, the web site responds immediately with a display of the latitude and longitude corresponding to the street address.) The Google site provides this information for the whole earth. For devices purchased over the Internet or for other mail-order purchases, the latitude and longitude information preferably is programmed into the device at the same time that the user's address is printed on the shipping package. The device is labeled with a label such as that shown in FIG. 1A to remind users that the device is programmed for use at only one location. The label preferably should be placed on the device at the time it is programmed with the use location information.

A potential technique for marketing these alert warning devices is to provide the unit's use location in the form to a computer chip that is to be inserted into a slot in a radio unit that is sold at commercial retail stores such as Home Depot and Radio Shack. At the time of sale the radio unit, the computer chip that will be programmed with the unit's use location could be ordered by the purchaser or a sales person at the retail store via the Internet. The chip would then be programmed by a computer at a dispensing location with latitude and longitude corresponding to the mailing address of the use location. A device label would also printed by the computer. The preprogrammed chip and label would then be mailed from the dispensing location to the use location and inserted by the user into a slot in the radio unit, and the label would be attached to the unit. Assuming millions of these are to be distributed, this process of programming and mailing the chip could be completely automated.

Central Station

Figure 2:
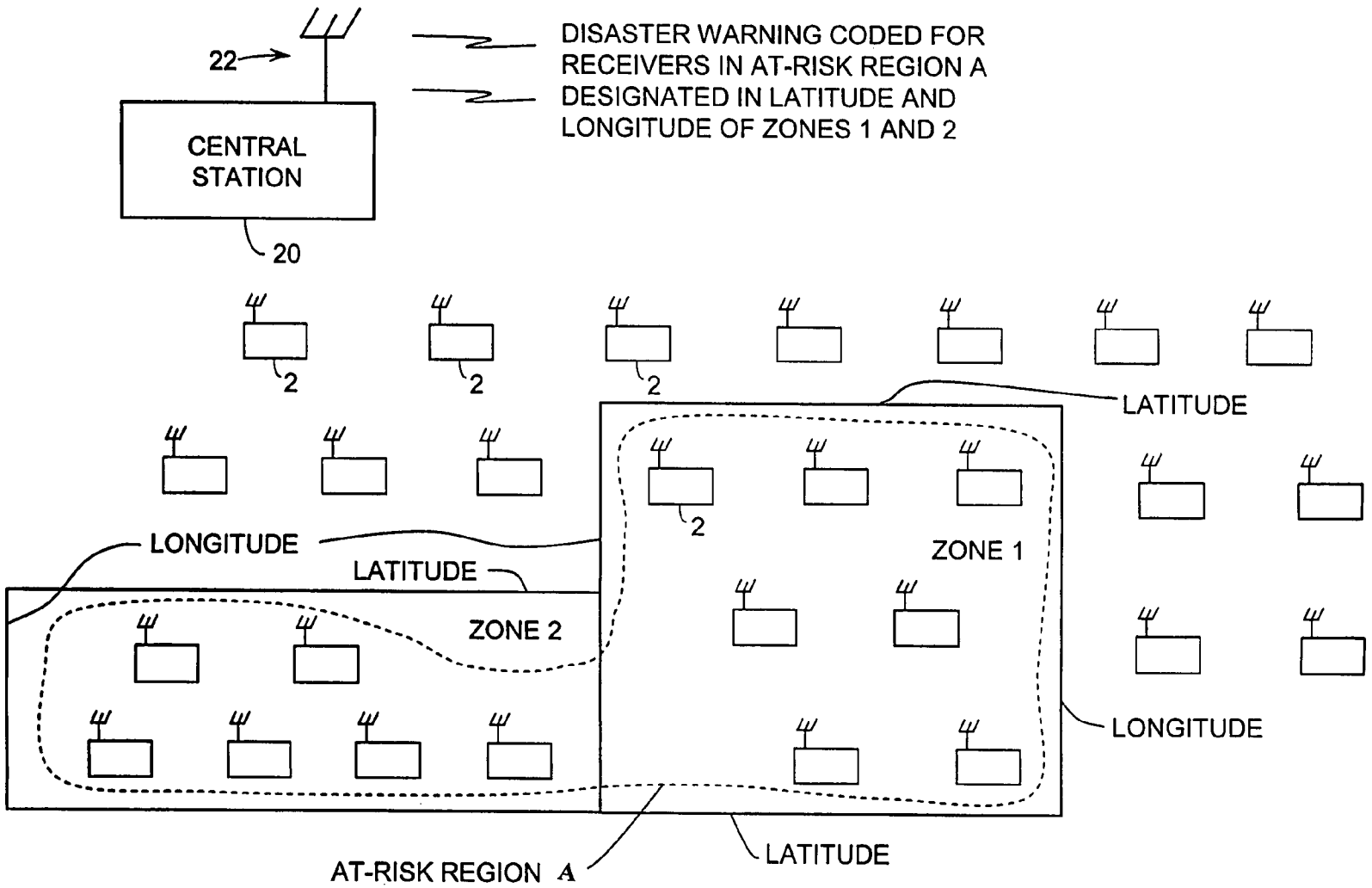
FIG. 2 describes a disaster alert system of the present invention.

Warnings of disasters are broadcasts from one or more central stations. In the United States, central stations are preferably operated by, or under contract with, the Homeland Security Administration. Each such central station shown as 20 in FIG. 2 is preferably equipped with a transmitter 22, preferably a frequency modulated (VHF) radio transmitter operating in a frequency range (such as about 108.0 MHz) to which the radio receivers of all of the alert warning devices in the warning system are tuned. Transmissions from the central station 20 or stations may be encrypted with an encryption code recognizable by all of the alert warning devices in the system. These central stations could be operated as a part of the SAME system discussed in the Background section and could utilize some of the facilities of the National Weather Radio network. Or the central station(s) could be operated independent of the SAME system.

Identification of At-Risk Regions

Transmissions from the central station are directed to alert warning devices in specific at-risk regions. These specific at-risk regions are preferably identified by personnel such as fire officials, weather personnel, police, military, and homeland security personnel. A description of an at-risk region is conveyed to the central station. Personnel at the central station convert the description of the at-risk region into at-risk latitude and longitude zones. The at-risk zones in most cases will preferably envelop the at-risk region as closely as feasible. A preferred technique for doing this is to utilize digital maps which may be displayed on computer monitors such as the satellite maps available at Google Earth. As explained above, these maps may be overlaid with latitude and longitude lines with resolution of 0.1 second of arc (corresponding to about 10 feet) or 0.01 second of arc (roughly 1 foot). Computers at the central station are preferably programmed to permit operators to use a computer mouse to draw on the monitor face up to ten approximately rectangular zones enveloping the at-risk region, with the borders of the rectangular zones being co-aligned with latitude and longitude 0.1 second lines. FIG. 2 is an example where an at risk region A is enveloped by rectangular zones 1 and 2 defined by latitude and longitude lines. This drawing identifies 13 receivers in zones 1 and 2 to which a warning would be transmitted.

Figure 4:
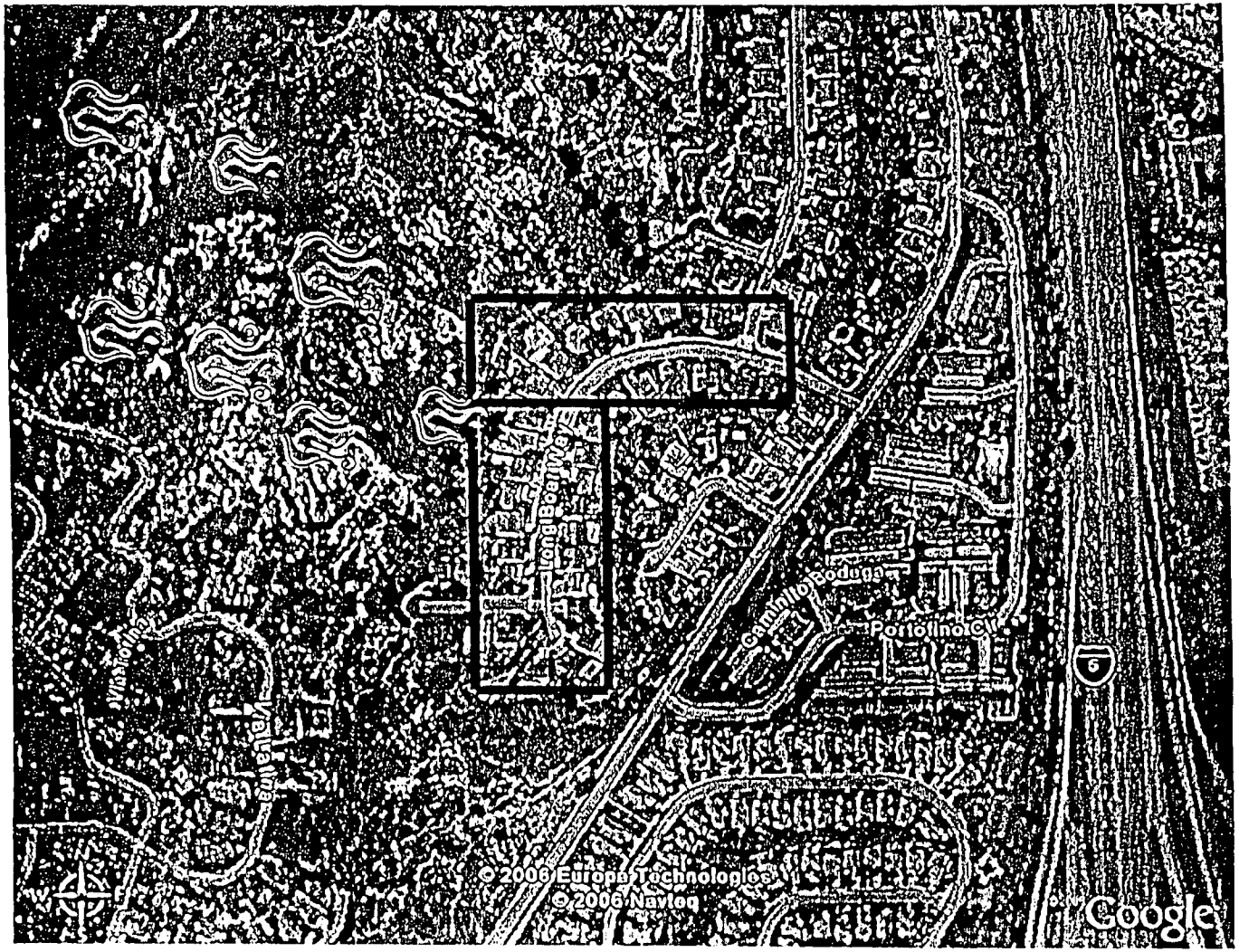
FIG. 4 is a map showing an at-risk region.
Figure 5:
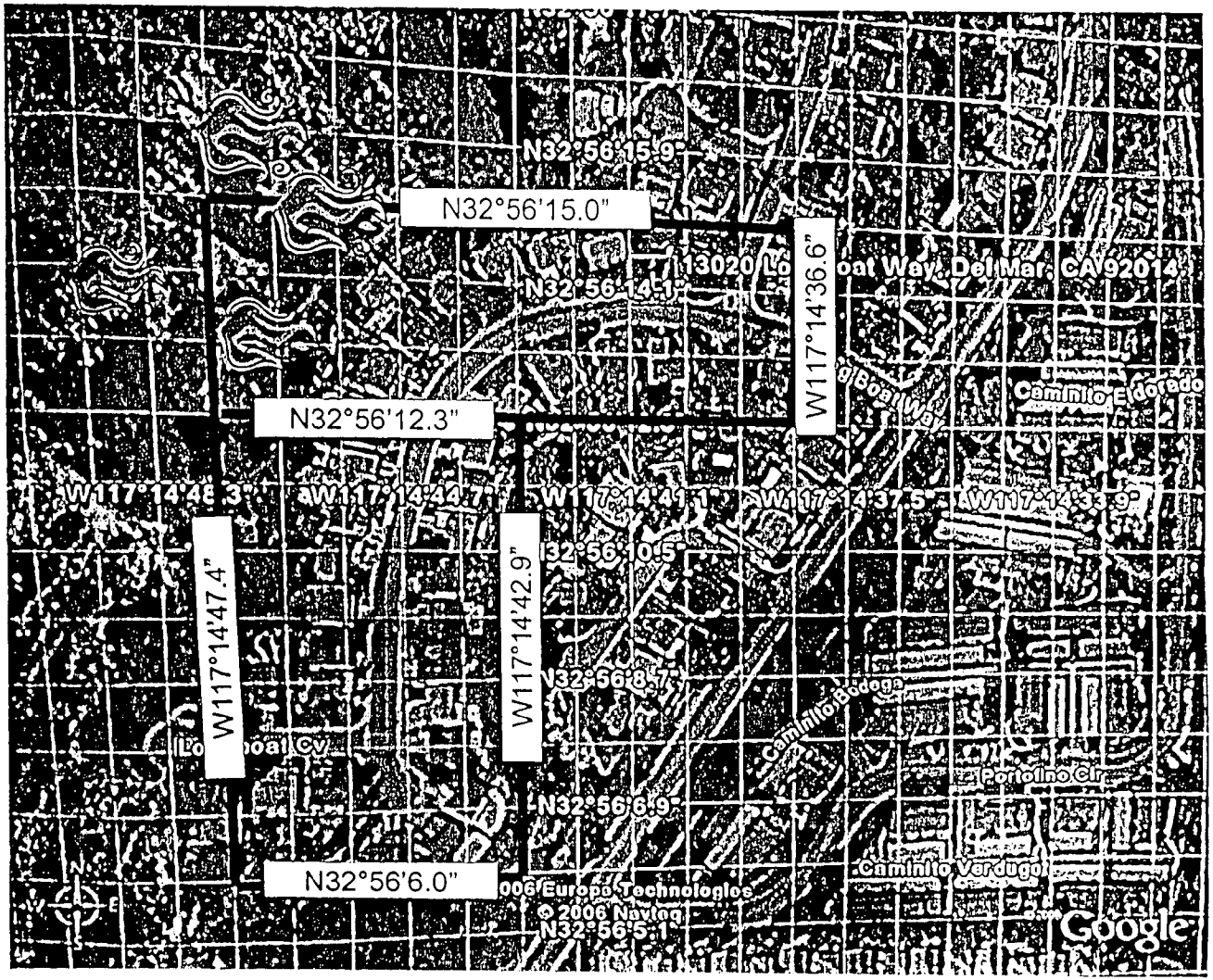
FIG. 5 is a magnified view of the at-risk region.
Figure 8:
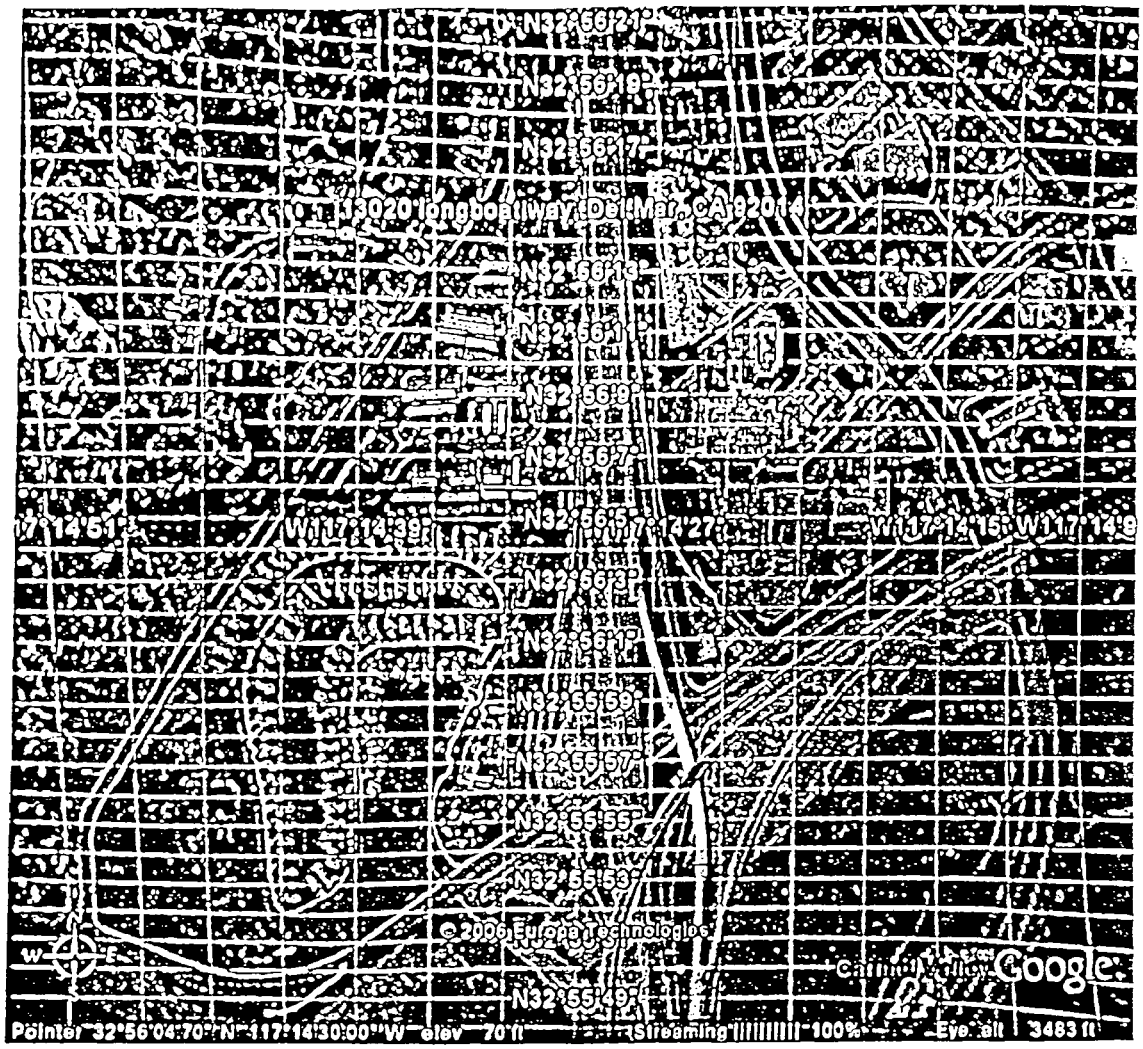
PRIOR ART FIG. 8
FIG. 8 is a prior art Google Earth map.

FIG. 4 is a copy of a printout of the Google Earth map shown in FIG. 8 with two rectangular zones enveloping the residences located on a cul-de-sac street, Long Boat Way, Del Mar, Calif. A forest region lies just north of Long Boat Way and a forest fire in this region could put the people living on Long Boat Way in grave danger and immediate evacuation may be necessary. A telephone call from fire officials to Homeland Security Personnel at the central station identifying Long Boat Way as an at-risk region would permit central station personnel to create two zones as shown on FIGS. 4 and 5 enveloping the 38 homes located on Long Boat Way by drawing the two rectangles as shown in the figures. FIG. 5 shows a magnified printout of a map including Long Boat Way produced using the Google Earth web site by manipulation of a computer mouse to produce the magnification. FIG. 5 shows the 6 latitude and longitude lines needed to create the two at-risk zones with the latitude and longitude lines identified to a precision of 0.1 second of arc (about 10 feet).

The Warning and Instruction Message

Preferably, a computer processor at the central station is programmed with software that converts the latitude and longitude information of the two at-risk zones described above to digital data that is formulated into a digital message header. A warning and instruction message is preferably prepared by central office personnel and combined by the processor with the header (which contains disaster alert device wake-up information for potential at-risk regions). Central office personnel preferably are trained to respond quickly in the case of an alert like this from fire officials. Applicants estimate that these personnel should be able to prepare the message for transmission within five minutes of receipt of a legitimate alert such as the one described here.

Programming the Alert Warning Devices

As explained above, preferred embodiments eliminate the need for any programming by the actual owner/user of the alert warning devices of the present invention. These devices will be rarely called upon to operate, but when they are called upon to operate their proper operation may very well be a matter of life or death. For this reason people very familiar with the device should program it and once programmed it should not be tampered with except to replace its battery when appropriate. Proper operation should be confirmed by periodic tests where test warnings with advanced notification are transmitted from the central office.

Conserving Battery Power

In preferred embodiments, many, probably most, alert warning devices are battery operated like most smoke detectors. This allows the devices to be independent of utility power which could be rendered unavailable by the same disaster that is the subject of the warning to be communicated. Also, a battery powered unit is likely to be less costly to manufacture and less expensive to the user than a utility-wall powered unit. Digital clocks and watches can operate on less than 0.007 amp-hours per week but radio receivers require about 3 amp-hours per week if operated continuously. A typical long life battery of the type used in a smoke detector can provide about 0.5 amp-hours of electric energy, so the battery could not sustain continuous operation of a typical radio receiver for more than a few days. Applicants desire that their alert warning devices routinely operate for at least one year between battery changes. To conserve battery power, Applicants preferred battery-powered devices spend the great majority of their lives in a sleep mode, operating like a lazy clock, and consuming only about 0.007 amp hours per week. They wake up periodically to check on things and if there is no emergency they quickly go back to sleep.

To accomplish this, battery powered devices are programmed at the factory to operate normally in sleep mode for 4:59 out of each 5:00 minutes, and to switch to radio receive mode for only about one second out of each five minutes. Preferably, a very short message will be transmitted to each alert warning device during the one second awake period of radio mode operation. The device will record the message and analyze it. The message will include the header created by the central station that will indicate whether or not an active warning message, for the device's general location, follows and if so will direct the unit to "remain awake" and check more of the message details. If no "remain awake" command is detected, the device immediately resumes the sleep mode. Each device knows its own latitude and longitude (global position) and is programmed to compare its global position to any potential "at-risk" regions by the approximately rectangular latitude and longitude zones identified in the headers of messages transmitted by the central station. Typically, the message from the central station coming each five minutes will not include any directed warnings, and when it does include a directed warning, the warning will be directed to only a very small portion of the devices within the audience of the central station. When there is no warning, and for those devices that are not within the at-risk zones to which a warning is directed, the header will in effect be saying, "No problem for you and your family," so the device then switches immediately back to sleep mode. If the device does not receive a message or if the message is other than "no problem", the device remains awake.

If no message is received, this could mean that somehow the clock of the device and the clock at the central office transmitter are out of synchronization or that there is a problem at the central office; therefore, the device is programmed to stay awake and listen for a clock synchronization signal from the central office. Such a synchronization signal should be received within 5 minutes, at the next routine transmission from the central office. If it receives a synchronization signal, it synchronizes itself. If it does not receive a synchronization signal, it activates an indicator (such as a low power consuming LED) to alert the user that there is a 'loss of signal' problem and that the alert warning device is not in communication with the central office. The device preferably is programmed to beep periodically if more than eight hours pass without synchronization. The device preferably also beeps if battery voltage drops low enough to indicate its useful life is nearing its end. Specific estimates of power consumption are described below.

Estimate of Power Consumption

Operation of the alarm receiver for one second out of every five minutes (a duty cycle of about 0.33 percent) is sufficient to provide for a greater than one-year battery life. A standard 9-Volt battery (Duracell MN1604) provides more than 500 mA-hours (milliamp-hours) of current (4.5 watts-hours). Devices incorporated in the alarm receiver may vary, but will have approximately the following current drain from the battery:

| Receiver and Controller | |
|---|---|
| RF Receiver (similar to Micrel MICRF007): | 3 milliamps (mA) during operation |
| Microcontroller (similar to Microchip PIC18F8722): | 10 mA during operation |
| Total current draw during operation of receiver and controller: | 13 milliamps (mA) |
| **Wake-Up Receiver or Timer** | |
| Wake-Up Receiver (similar to Atmel ATA5282): | 4 microamps during operation |
| Duty cycle timer: | 10 microamps during operation |

A duty cycle of about 0.33% means that the receiver and controller will only draw the 13 mA of current from the battery during the 0.33% of the time that it is checking for a signal from the central office. The fraction 0.33% of 13mA is about 0.043mA. In addition, the wake up receiver or a timer will draw about 0.004 to 0.010 mA continuously so that the total draw will normally be in the range of about 0.05 mA. If a 500 mA-hours battery is employed to power the receiver unit, then the battery will last approximately 500 mA-hours/0.05 mA=10,000 hours, or approximately 13.9 months, a little more than one year.

What If the Device Receives a Real Disaster Alert Warning

Only a very small percentage of the disaster alert warning devices of the present invention are expected to ever receive a real disaster alert warning. If they do however, it is very important that they respond properly. As indicated above, during each of the regular periodic one-second radio mode intervals, each battery operated device wakes up and records and analyzes the message sent to it by the central station. If the message is other than, "No problem for you and your family", the device stays awake. If a warning is to be sent, the initial message will so indicate, and the message prepared by the central office will be transmitted digitally. The processor is preferably programmed to sound an alarm with alarm unit 12 as shown in FIG. 1 if called for by the message and to convert the digital voice message back a voice message that is broadcast by speaker 11. The voice message will preferably describe the nature of the warning and provide instructions as to a proper response. A specific example of such a message is provided below in a Section entitled "Disaster Example".

Identifying the Type of Disaster

An important improvement of the present invention over prior art warning devices is that detailed messages may be transmitted as to the particular nature of the impending disaster. Also, detailed instructions as to proper responses may be provided.

Encryption Techniques

In preferred embodiments of the invention, messages from the central office are encrypted using public-key cryptography techniques. These techniques utilize a private key and a public key. The private key is used at the central station to automatically encrypt headings and messages. The private key is kept secret. Each alarm device is pre-programmed with a public key that is used to decrypt the data sent out by the central station. The public key resides in each and every warning receiver that is installed in home and business. The public key will only decrypt messages that are encrypted using the corresponding private key at the central station. In this manner, the public key is used to validate the identity of the sender (the central station) and to decrypt the message. Implementations of this type of cryptography are sometimes termed a digital signature due to the identity validation nature of the operation. Useful encryption techniques are described in detail in many available prior art sources. For example, a good description of available encryption techniques is provided on the Internet at www.wikipedia.org.

Each separate central station could have its own private key and the alarm devices in its audience would all be programmed with a corresponding public key. Devices could be programmed so that if a private key at a central station is compromised a new one could be provided and devices in the station's audience could be provided with a revised public key via an appropriate message transmitted from the central station.

Encryption prevents unauthorized personnel from producing improper alarms by the disaster alarm devices. Also, the radio frequencies chosen for use with the present invention should be frequencies reserved for emergency radio systems so that anyone attempting to transmit improper or false warnings should be subject to criminal prosecution.

Message Format

Preferably, typical message packets from the central office, transmitted at exactly 5-minute intervals, will be comprised of a message header, at-risk zone definitions, and a message body. Exactly every 5:00 minutes (synchronized to a standard time such as 12:00, noon, 12:05 PM, 12:10 PM etc), each battery operated alert warning device activates its radio receiver and processor controller and receives and checks for a message header from the central station, which takes less than one second. Most of the time, the message header will carry no warning and the alert warning device will resume its sleep mode. Occasionally however, the message header may include a potential risk to a nominal at-risk zone identified by minimum and maximum latitude and minimum and maximum longitude designations, preferably only to the nearest minute of arc, corresponding to about 6,000 feet. Initial nominal identification of at-risk regions are used to minimize the amount of information that needs to be analyzed initially by the disaster alert devices. This usually will permit most of the devices within the audience of the central station to go back to sleep without receiving and analyzing the bulk of the transmitted warnings. When warnings are transmitted, all alert warning units within the audience of the central station compare the latitude and longitude values defining the nominal at-risk region against its own latitude and longitude stored in the memory of alert warning device. If the processor determines that the device is in the nominal at-risk region, the processor extends the devices wake-up period long enough to receive the next segment of the message. The next segment of the message includes precise at-risk zone definitions, which contain latitude and longitude boundaries of up to ten approximately rectangular zones, to the nearest tenth of a second of arc corresponding. Each alert warning device in the nominal at-risk region will next use the precise at-risk zone definition information to determine whether it is inside a precise at-risk zone. If the alert warning device determines that it is inside a precise at-risk zone, then the unit will remain awake to receive, record, decode, and act on a message body that follows. If it determined that it is not in a precise at-risk zone, it goes back to sleep.

In this preferred embodiment the message header transmitting the nominal at-risk zone latitude and longitude information is comprised of 64 bytes of information, and takes less than one second to receive and interpret at each alert warning device. The precise at-risk zone definitions are comprised of 256 bytes of data, for up to ten precise at-risk zones, and may take about four seconds to receive and interpret. The actual time will depend on data rates chosen. These estimates are based on a data rate of 64 bytes per second. The message body preferably is comprised of up to 18,880 bytes of information, and takes less than 295 seconds to be transmitted and received at the alert warning devices. The complete message would be comprised of:

| Message Header (64 bytes total): | |
|---|---|
| 1. A synchronization signal: | 8 bytes; |
| 2. Go back to sleep command (no alarms anywhere) | 2 bytes; |
| 3. Nominal at-risk zone minimum latitude (degrees, minutes) | 5 bytes; |

-continued

| | |
|---|---|
| 4. Nominal at-risk zone maximum latitude (degrees, minutes) | 5 bytes; |
| 5. Nominal at-risk zone minimum Longitude (degrees, minutes) | 5 bytes; |
| 6. Nominal at-risk zone maximum Longitude (degrees, minutes) | 5 bytes; |
| 7. Other Preliminary Information, spare: | 34 bytes; |
| Precise At-Risk Zone Definitions, to the nearest 0.1 second of arc (512 bytes total): | |
| 1. Min and Max Latitude and Longitude of At-Risk Zone 1: | 40 bytes; |
| 2. Min and Max Latitude and Longitude of At-Risk Zone 2: | 40 bytes; |
| 3. Min and Max Latitude and Longitude of At-Risk Zone 3: | 40 bytes; |
| 4. Min and Max Latitude and Longitude of At-Risk Zone 4: | 40 bytes; |
| 5. Min and Max Latitude and Longitude of At-Risk Zone 5: | 40 bytes; |
| 6. Min and Max Latitude and Longitude of At-Risk Zone 6: | 40 bytes; |
| 7. Min and Max Latitude and Longitude of At-Risk Zone 7: | 40 bytes; |
| 8. Min and Max Latitude and Longitude of At-Risk Zone 8: | 40 bytes; |
| 9. Min and Max Latitude and Longitude of At-Risk Zone 9: | 40 bytes; |
| 10. Min and Max Latitude and Longitude of At-Risk Zone 10: | 40 bytes; |
| 11. Other At-Risk Zone Information, spare: | 112 bytes; |
| Message Text/Audio (18,880 bytes total): | |
| 1. Message Type (text, audio, other) | 2 bytes; |
| 2. Message Length that follows (in bytes) | 4 bytes; |
| 3. Message | N bytes; |

Message Transmission

In preferred embodiments, the system operates at a frequency of approximately 106.5 MHz. Operation of the system at a frequency of 108.0 MHz allows for non-line-of-sight operation, and for some penetration through building structures. This 108.0 MHz frequency is at the edge of the standard FM radio band and a wide variety of inexpensive components are available in the this frequency range. Other frequencies of operation could be used, and the choice is not that important, except for the desire to cover a large area with relatively few transmitting stations. Data can be modulated onto the carrier frequency using several techniques, but standard frequency shift keying is commonly used. A data rate of 512 bits per second is assumed in this embodiment and provides a suitable rate for transmission of the data within a 300 second window. A higher data rate could be used to allow more complex messages to be sent. The one-second awake time of the alert warning devices should be ample, and in fact could probably be shortened to extend battery life.

Disaster Example

As described above, FIGS. 4 and 5 show a hypothetical example of an impending disaster. A forest fire in the Torrey Pines Reserve in Del Mar, Calif. is bearing down on the 39 houses located on Long Boat Way as shown in the figures. If the present invention were being utilized in Southern California with a central station located for example on Mount Woodson in San Diego County, warnings could be transmitted to the people living on Long Boat Way without disturbing anyone in San Diego County other than those people.

The central station would be notified by a fire department person that persons living on Long Boat Way should be evacuated immediately since the fire in the reserve is approaching the street rapidly and could ignite the houses at the eastern end of the cul-de-sac trapping all of the residents of the street. A computer operator at the central station would locate Long Boat Way on a satellite map (such as the Google Earth map) displayed on a computer monitor as shown in FIG. 5. The operator uses a computer mouse to draw two approximately rectangular shapes on the map with the lines of the approximate rectangles corresponding to latitude and longitude lines as shown in FIGS. 4 and 5. The lines are drawn to a precision of 0.1 seconds of arc as shown in FIG. 5. The operator is able, using only two at-risk zones, to precisely define the immediate at-risk region needing to be evacuated so that an evacuation order can be transmitted to the people living on Long Boat Way without unnecessarily frightening any other persons. As soon as the operator is confident that he has the at-risk region properly identified with the two rectangles, he clicks an appropriate logo provided on the monitor and the computer automatically creates a header and part of the message for a disaster warning to be transmitted. While the computer operator is identifying the at-risk zones as described above another operator at the central station records the following voice message:

> "This is an emergency warning from the San Diego Office of the Homeland Security Administration! This is not a test! There is a major forest fire currently burning in the Torrey Pines Reserve northwest of and approaching Long Boat Way. All residents occupying structures located on Long Boat Way and Long Boat Cove are instructed to evacuate immediately in an easterly direction on Long Boat Way, then proceed south on Portofino Drive to Carmel Valley Road. This is not a test, this is an actual emergency. All people should immediately begin evacuation."

This voice message is digitized and compressed by the central station computer using mp3 (or other) techniques and combined with the portion of the message prepared by the computer operator. The operator then clicks a logo to transmit the combined message. The computer processor then transmits the message at the next one second awake window at a 5-minute interval as described above. Disaster alert devices powered by wall power are awake continuously so a message to these devices could be sent as soon as it is ready. The message to the battery powered units could be delayed up to 5 minutes.

As indicated above, the header portion of the message will designate the nominal at risk zone with the following latitude and longitude information:

N32°56'-N32°57' and W117°'14'-W117°15'.

This corresponds to a region which is more than one mile square and includes much of the city of Del Mar and portions of the city of San Diego. All of the alert warning devices in the nominal at-risk region will remain awake and analyze the next portion of the message. The first part of the rest of the message more precisely defines the at risk region with the two at-risk zones shown in FIG. 7. This information is:

N32°56'06.0"-N32°56'12.3" and W117°14'42.9"-W117°14'47.4"

N32°56'12.3"-N32°56'15.0" and W117°14'36.6"-W117°14'47.4"

All of the alert warning devices in the homes on Long Boat Way respond to the central station transmission by initiating an alarm of the type shown at 12 in FIG. 1A and broadcasting the voice message printed above. Alert warning devices outside the precise at-risk region will not initiate an alarm or otherwise disturb anyone.

Since this is a major fire the fire department may want a general warning to be transmitted by the central station to a larger region without an immediate evacuation order. In this case the fire department should give the central station guidance as to the size of the larger region to be warned and a second message should be sent to people in the larger region via their alert warning devices. This message would not require evacuation but would explain that the people living on Long Boat Way have been ordered to evacuate.

High Alert and Very High Alert Modes

As indicated in the above disaster example, the central station could be delayed up to five minutes in issuing the warning since the battery operated alert warning devices could be in their sleep modes for that period of time. To avoid this, the battery operated disaster alert devices could be provided with software that would permit the central station to put them in a high alert mode or a very high alert mode. In a preferred embodiment the high alert mode would cause the devices to wakeup at one-minute intervals (instead of five) for one second and in the very high alert mode the devices would be caused to remain awake continuously for a specified period of time, such as ten minutes or another appropriate time to prepare a specific message to be transmitted. The change of mode could be transmitted to all of the units within the audience of the central station or to any portion of its audience based on latitude and longitude designations as described above. Preferably, the central station would appropriately limit the periods of high alert or very high alert since operation in these modes greatly increases the battery drain. As explained above units powered by wall-utility power preferably are programmed to stay awake in radio receive mode continuously since the power drain is small compared to typical overall house electric power usage; however, these devices too could be programmed to take advantage of the same sleep-awake strategy proposed for the battery powered units.

Operational Flow Charts

Figure 6:
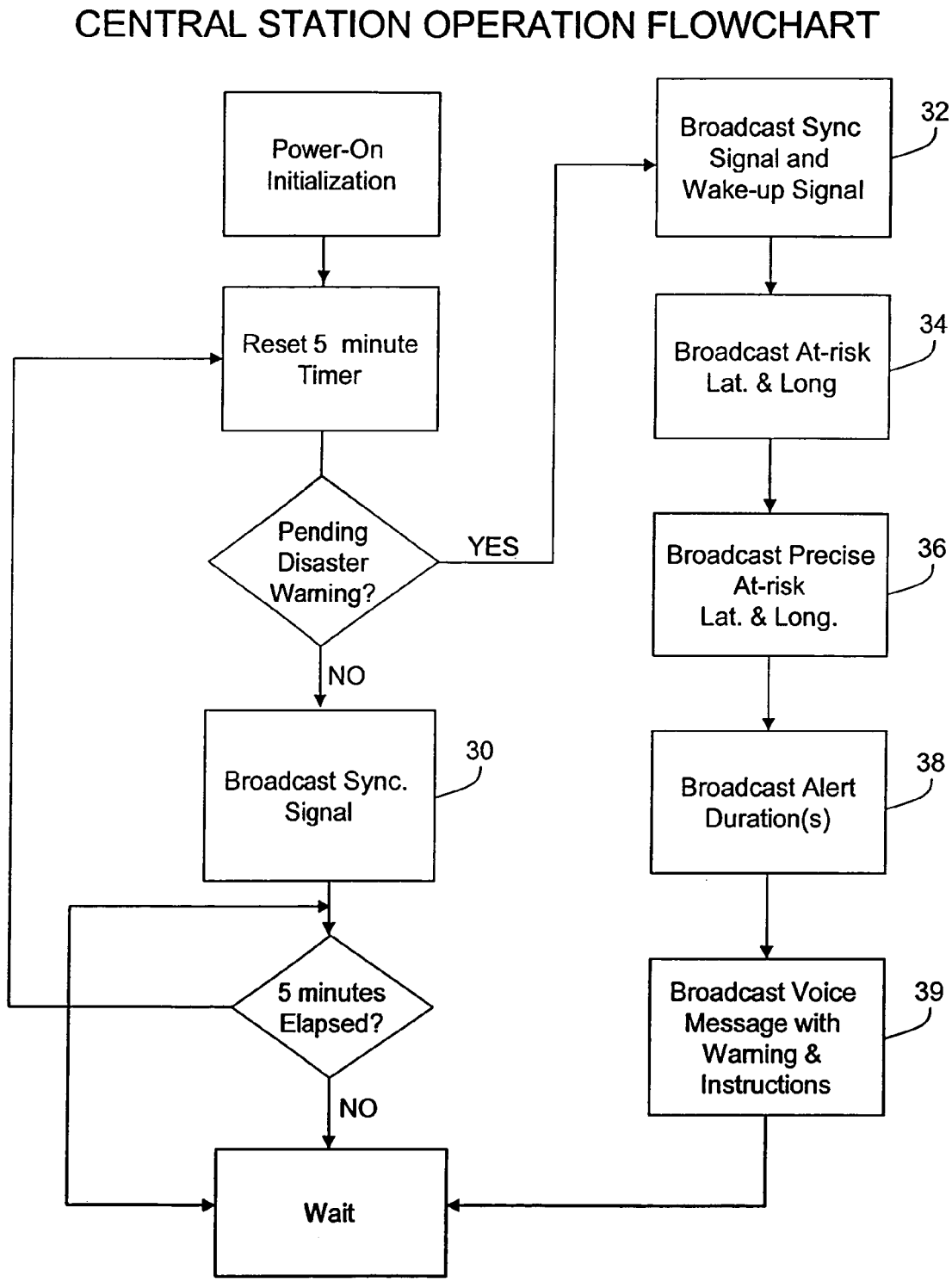
FIGS. 6 and 7 are flow diagrams showing features of a preferred embodiment.
Figure 7:
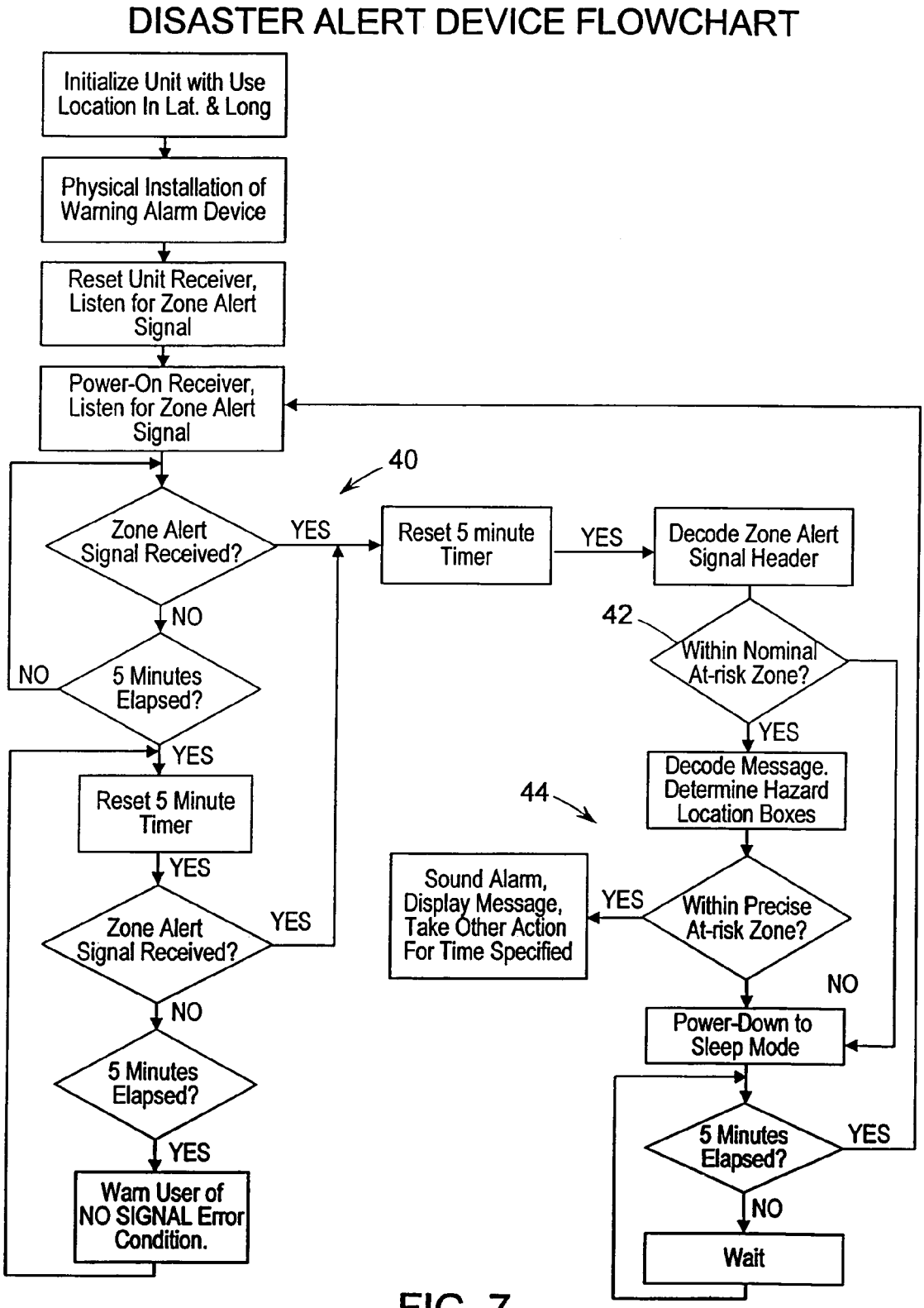

FIGS. 6 and 7 are flow charts describing how the processors at the central station and in alert warning devices may be programmed and operated in preferred embodiments of the present invention. As shown at 30 and 32 in FIG. 6 the computer processor is set up to broadcast at least a synchronization signal each five minutes to keep all battery powered alert warning devices in its audience in synchronization. If there is a pending disaster it also broadcast a wake up signal directed to a nominal at-risk region defined by nominal latitude and longitude as shown at 34. This typically allows most of the alert warning devices in the audience of the central to go back to sleep. The central station also broadcast the precise latitude and longitude as shown at 36, the alert duration as shown at 38 and a voice message with warning and instructions as shown at 39. This allows the devices in the nominal at-risk region to receive and analyze the precise latitude and longitude and determine if they are within it. If so they will broadcast the message for a duration specified by the central station.

FIG. 7 is a flow chart describing how the processors in the alert warning devices may be programmed and operated in preferred embodiments of the present invention. This chart also indicates as shown generally at 40 a preferred technique of one second of radio receive operation each five minutes to conserve battery power. If the processor determines from header that the alert warning device is within the nominal at-risk region as shown at 42, it decodes the rest of the message and determines if the device is in the precise at-risk region. If no, the device goes back to sleep. If yes, it sounds an alarm and broadcasts the message as instructed by the central office as indicated at 44. If it is not in the precise at-risk region the device goes back to sleep.

Alerting Emergency Crews

The present invention can be applied by the central office to activate emergency crews. To do so the central office would program its computers with the latitude and longitude of the residences of members of various types of crews such as special police units, and special fire fighting units. These lists could be kept on a shift-by-shift basis and updated continuously so that the central station personnel would know which groups of personnel are off duty at any time. By directing a message to the disaster alert device of each crew member (by specifying their precise latitude and longitude) the central station personnel could immediately issue a request to these personnel to report to duty in case of a severe emergency.

Prototype Device

Applicants have constructed a rough prototype device having some of the features of the present invention using parts from a remote controlled toy truck and radio receiver, both purchased off-the-shelf from Radio Shack. The toy truck transmitter and the radio receiver operated at 75 MHz. A digital voice recorder to provide prerecorded warnings activated by the transmitter was also purchased from Radio Shack. The device was incorporate with a smoke alarm that was purchased from Target.

Voice Message Alternatives

The system could be set up to transmit voice messages through a variety of alternatives. These include digital transmission of voice data that would be broadcast by the alert warning devices via a voice synthesizer. This approach is probably the most efficient in terms of bytes of data needed to transmit a specific voice message. Voice can also be transmitted digitally and converted to voice with much higher quality using well-known mp-3 techniques. Other digital audio techniques are available that could be adapted to transmit and deliver the voice message. Another approach is to have the central station transmit a signal to the alert warning devices to switch to a receive configuration that would receive an analog radio message. The alert warning devices could be preprogrammed with recorded a variety of recorded texts and warnings each of which could be activated and broadcast based on instructions for the central station.

Alternative At-Risk Designations

There are alternate techniques for identifying at-risk regions that could be utilized to direct a warning from the central station to the alert warning devices. Preferably these would use indicia that are associated with the location of the alert warning devices. These include address information such as Post Office ZIP codes, city and state names, and telephone area codes. Preferably this information is in addition to the latitude and longitude information. This information could be programmed into the alert warning devices and the devices could be programmed to examine headers for any of these indicia for warnings directed to warning devices within the indicated regions.

Test Signals

Preferred embodiments may provide for periodic tests to assure users that their devices are operating properly without creating disturbances for those people who do not wish to be disturbed. A preferred technique would be the transmission from the central station of a 3-second pleasing bird call at a regular periodic time such as exactly noon on every Sunday. Users could listen for the timed transmission to gain some assurance that the warning system is in operation and that their government is watching out for them. Another approach would be to program the alert warning devices to turn on a low -power LED during the one-second wake-up periods. This would also give some assurance that the device is in working order. The system operators could also schedule test transmissions of test warnings with proper notice in advance. The voice message would also explain that "This is a test" so as to avoid any unnecessary alarm by the device users.

Tapping Into Always Available Power Sources

As an alternative to the battery powered approach described in detail above, alert warning devices of the type described above could utilize other available electric power sources. For example, the units could be powered with wall (utility) power at 120 Volt (AC) with or without a backup battery supply. The alert warning could incorporate a night light. It could also be incorporated into an alarm clock. The alert warning device could be incorporated into a smoke detector and utilize its power source, whether battery, wall or wall with battery backup. A good solution for business facilities is to incorporate the disaster warning devices with emergency building lighting which typically utilizes relatively large back-up battery power sources. With plenty of electric power and no need to worry about replacing batteries, the devices could be programmed to stay in the radio receive mode continuously.

Radio and Television

Alert warning devices of the type described above (programmed with latitude and longitude) could be incorporated into radio or television sets, with each warning device programmed to turn the set on if it is not already on or to cause an interruption of the radio or television set if it is already on upon receipt of an emergency broadcast directed to it from the central station. The radio or television would then broadcast the warning as directed by the central station. Warning devices in television sets should be programmed to replace the monitor picture with an appropriate still picture indicating that an emergency warning is being transmitted.

The alert warning device could be a part of a new radio system that continuously broadcast music or other desired programming from a central station. A radio spectral region could be set aside for this new warning system. That spectral region, if it is broad enough, could be used for perhaps several commercial free soft music channels for which users may be willing to pay a monthly fee. Only on very rare occasions (when an emergency warning is to be broadcast to the particular user, based on his latitude and longitude) would the music be interrupted.

Another approach would be for existing radio and television systems (including cable systems) to incorporate disaster warning messages (directed to particular at risk regions designated by latitude and longitude as described above) into their regular radio and television transmissions. Disaster warning devices installed in radio and television sets could in be programmed with the latitude and longitude of the use locations and also programmed to scan the incoming radio or television signals for headers with latitude and longitude designation directed at the use location. When the device detects a warning directed at the use location, it would turn on the set if not on or interrupt the programming if it is on and would then cause the set to broadcast the warning. Where the user has cable television, it may be preferable for the disaster alert device to be separate from the television set but programmed to monitor the cable signal for latitude and longitude warnings directed to an at-risk region in which it is located. The radio, television and cable systems would normally receive disaster-type information from public sources such as Homeland Security or fire and police organizations.

Mobile Units

Figure 3:
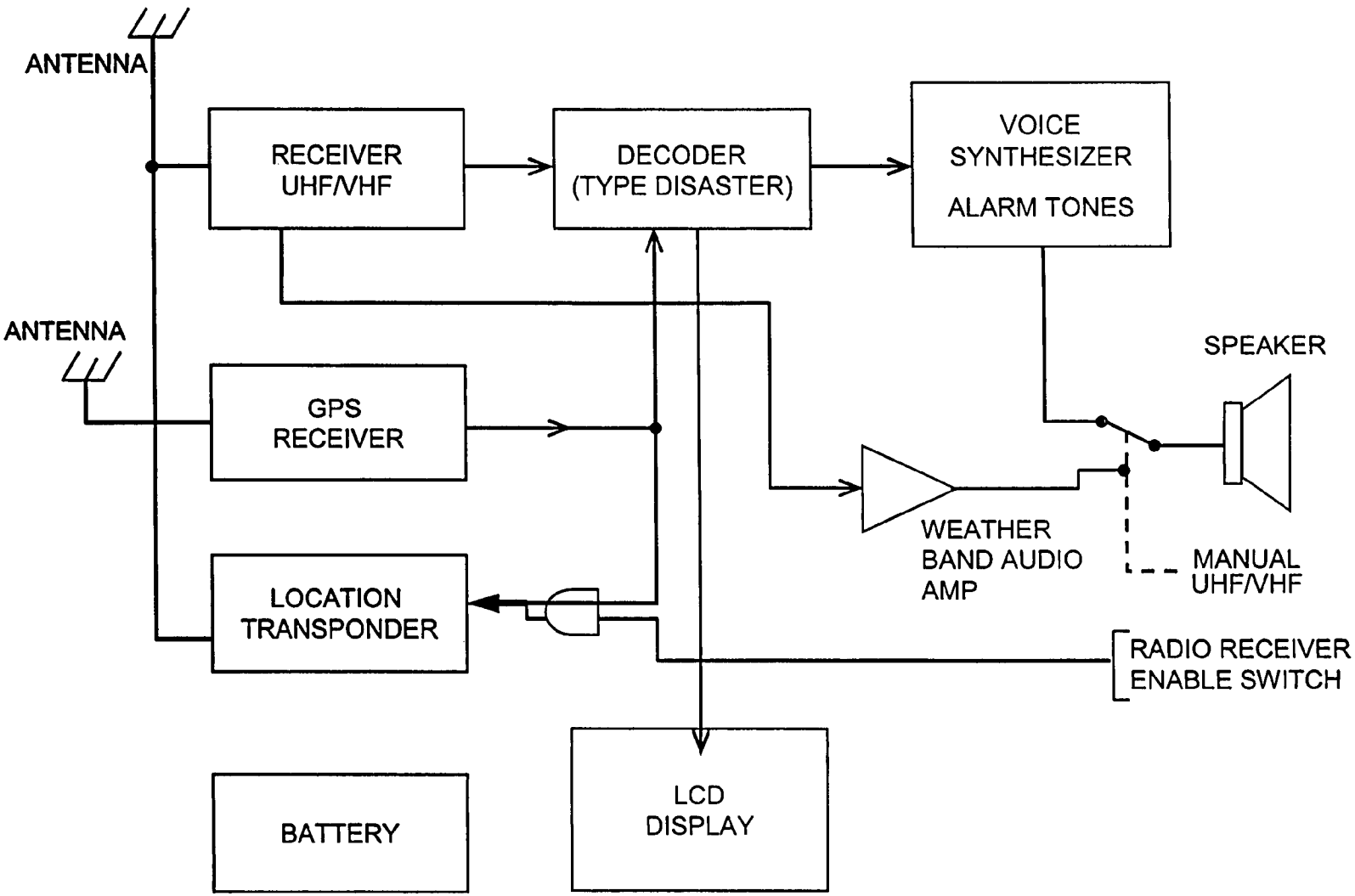
FIG. 3 describes a second preferred disaster alert device.

In a preferred embodiment, mobile disaster alert devices incorporating a GPS device would be made available for vehicles such as automobiles, trucks and boats. These devices compare their actual latitude and longitude with the latitude and longitude information included in the header broadcast by the central station to determine if the device is in an at-risk region. These mobile alert warning systems can also be incorporated in electronic devices that people typically carry around such as laptop computers and cell phones. These devices can get their GPS position from an incorporated GPS device or other sources. FIG. 3 is a drawing showing a unit with a GPS receiver.

While the present invention has been described in terms of specific preferred embodiments and the prototype, the reader should understand that many changes and modifications can be made within the scope of the invention. For example many encryption techniques can be utilized to assure the system is not improperly manipulated to produce false alarms. Central stations may also designate regions to which alerts are transmitted by using designations other than latitude and longitude, such as street addresses or area codes. Also, the central station could also broadcast the location of a hazard and a warning radius, and the alert devices could be programmed to decide whether or not an alert should be provided. Preferred embodiments will operate with wall power at 110 Volts AC rectified down to 9 volts with a 9 volt NiCad battery backup. The alarm could be set up to respond selectively (and differently) to independent alarms from the following organizations:

1. Local Household Fire alarm;
2. Local Household Intruder alarm;
3. National Weather Service for severe weather or tornado;
4. Local Fire/Police for public emergencies or advisories;
5. Emergency Broadcast System;
6. State Government alerts;
7. FEMA;
8. Tsunami advisory organizations;
9. Dept of Homeland Defense;
10. Other Authorized and selected agencies.

The SAME system described in the Background Section has developed 62 code for that many emergency situations and these codes could be incorporated into the system of the present invention. The present invention could be incorporated into the SAME system or it could be operated independent of it. Each originating agency or system would have its own private key for encryption of the activation signal (which is kept secret by that organization). Each warning receiver in every home or business would have the same set of decryption keys for the organizations (the public keys). Each central station may have at least one private key. More than one private key could be available to each central station and alert warning devices could be programmed with more than one public key and instructed via transmissions from the central stations at which one or ones to respond to. The receiver could only decrypt an alarm signal (using the public key) if it were encrypted using a secret private key. Devices could be initially programmed to permit reprogramming of decryption keys via an open channel, in they event of a compromise of one of the private encryption keys. Installation of the system may include (automatically over-the-air) initialization of the public decryption keys. Upon the occurrence of a public emergency or hazard, the central office would switch its transmission to the encrypted signal from the originating agency, which would then be decrypted at the warning receiver units in people's homes and the appropriate alarm siren, text, or voice message generated. In cities with tall buildings alert warning devices could be programmed with altitude and/or floor level so that separate warnings could be directed devices located on specific floors of the buildings at specific locations. In a 911 situation people in the top floors of all tall buildings within appropriate regions could be evacuated as soon as Homeland Security learns that a airline plane has been hijacked. In this situation each floor could be evacuated starting at the top of the tall buildings with the lower floors having their evacuation notice delivered successively at five-minute intervals. Additional features can be added to the disaster warning devices such as those shown in FIG. 3. So the scope of the invention should be determined by the appended claims and their legal equivalence.

What is claimed is:

1. A disaster alert system comprising:

A) at least one central station for transmitting disaster alert information by radio directed at disaster alert devices at use locations in specific at-risk regions defined by latitude and longitude, B) a plurality of disaster alert devices, each device adapted to operate for at least one year on electric power from a smoke detector type battery and each device adapted for use at a specific stationary use location in a disaster alert system, with each disaster alert device comprising:

1) a radio receiver, 2) an audio unit for alerting persons located at the use location to the precise nature of a disaster, and 3) a processor comprising a memory unit with latitude and longitude of the specific stationary use location stored therein prior to delivery to the use location of the disaster alert device at the specific stationary use location, wherein said processor is:

a) programmed to monitor radio transmissions from a central station for disaster alerts directed to all disaster alert devices located within an at-risk region defined by latitude and longitude information, b) programmed to compare the latitude and longitude information transmitted by the central station with the latitude and longitude information stored in its memory unit to determine if a message is directed to the disaster alert unit, and c) programmed to provide a voice warning via said audio unit of the nature of potential or actual risks to people at the use location based on information received by the disaster alert device from the central station when and only when the disaster alert device is among the disaster alert devices to which a transmission from the central station is directed, and d) programmed with a sleep mode adapted to switch on the radio receiver to receive mode for a short predetermined first time period out of a second much longer time period so as to permit the at least one year of operation with electric power from the smoke detector type battery source, and 4) a label specifically defining the use location wherein said central station comprises a radio transmit system programmed to transmit disaster warnings in a transmission having a header portion and a message portion wherein the header portion of the transmission contains latitude and longitude information defining at least one potential at-risk region; wherein the potential at-risk region is defined nominally to a first precision in the header portion and the radio transmit system is further programmed to transmit additional latitude and longitude information in the message portion defining precise at-risk regions with additional latitude and longitude information at a second precision that is more precise than the first precision.

2. The disaster alert system as in claim 1 wherein said central station is equipped with transmission equipment adapted to transmit disaster alert messages specifically tailored to at risk regions and to any of an unlimited number of specific risks that could be associated with the at risk regions.

3. The disaster alert system as in claim 1 wherein the first precision defines latitude and longitude to a precision of 0.1 second of arc or smaller.

4. The disaster alert system as in claim 1 wherein the latitude and longitude information in the header is provided to a precision of 1.0 second of arc or smaller.

5. The disaster alert system as in claim 1 wherein the latitude and longitude information in the header is provided to a precision of 0.5 second of arc or smaller.

6. The disaster alert system as in claim 1 wherein the latitude and longitude information in the header is provided to a precision of 0.1 second of arc or smaller.

7. The disaster alert system as in claim 1 and said processor is programmed with decryption software for decoding encrypted transmissions from the central stations.

8. The disaster alert system as in claim 1 wherein said audio unit is a voice synthesizer.

9. The disaster alert system as in claim 1 wherein said audio unit comprises a speaker.

10. The disaster alert system as in claim 1 wherein said audio unit is a digital recording device.

11. The disaster alert system as in claim 1 wherein said processor is programmed at the time of sale or installation with information identifying the use location of the device.

12. The disaster alert system as in claim 11 wherein the latitude and longitude information is obtained from the Internet.

13. The disaster alert system as in claim 11 wherein the latitude and longitude information is obtained from a GPS device.

14. The disaster alert system as in claim 1 wherein:

A) the central station also broadcast regular radio or television programming,

B) incorporates the disaster alert information into its broadcast signals and

C) a plurality of the disaster alert devices are programmed:

1) to scan the central station's broadcast signals for the disaster alert information, 2) to turn on a television or radio if it is off and 3) interrupt it if it is on and 4) broadcast disaster warning information directed to the use location of the disaster alert device.

15. A disaster alert device adapted for use at a specific stationary use location in a disaster alert system, said disaster alert device comprising:

1) a radio receiver adapted to operate for at least one year on electric power from a smoke detector type battery and, 2) an audio unit for alerting persons located at the use location to the precise nature of a disaster, and 3) a processor comprising a memory unit with latitude and longitude of the specific stationary use location stored therein prior to delivery to the use location of the disaster alert device at the specific stationary use location, wherein said processor is:

a) programmed to monitor radio transmissions from a central station for disaster alerts directed to all disaster alert devices located within an at-risk region defined by latitude and longitude information, b) programmed to compare the latitude and longitude information transmitted by the central station with the latitude and longitude information stored in its memory unit to determine if a message is directed to the disaster alert unit, and c) programmed to provide a voice warning via said audio unit of the nature of potential or actual risks to people at the use location based on information received by the disaster alert device from the central station when and only when the disaster alert device is among the disaster alert devices to which a transmission from the central station is directed, and 4) a label specifically defining the use location;

wherein the disaster alert device is programmed with a sleep mode adapted to switch on the radio receiver to receive mode for a short predetermined first time period out of a second much longer time period so as to permit the at least one year of operation with electric power from the smoke detector type battery source wherein said central station comprises a radio transmit system programmed to transmit disaster warnings in a transmission having a header portion and a message portion wherein the header portion of the transmission contains latitude and longitude information defining at least one potential at-risk region; wherein the potential at-risk region is defined nominally to a first precision in the header portion and the radio transmit system is further programmed to transmit additional latitude and longitude information in the message portion defining precise at-risk regions with additional latitude and longitude information at a second precision that is more precise than the first precision.

16. The device as in claim 15 and said device is programmed with decryption software for decoding encrypted transmissions from the central stations.

17. The device as in claim 15 wherein said audio unit is a voice synthesizer.

18. The device as in claim 15 wherein said audio unit comprises a speaker.

19. The device as in claim 15 wherein said audio unit is a digital recording device.

20. The device as in claim 15 wherein the latitude and longitude information is obtained from the Internet.

21. The device as in claim 15 wherein the latitude and longitude information is obtained from a GPS device.

22. The device as in claim 15 wherein the device is incorporated into a television set.

* * * * *